US007695422B2

(12) United States Patent
Schmieder

(10) Patent No.: US 7,695,422 B2
(45) Date of Patent: Apr. 13, 2010

(54) FOLDING DRUM AND METHOD OF OPERATION

(75) Inventor: Frank Schmieder, Plauen (DE)

(73) Assignee: Man Roland Druckmaschinen AG, Augsburg (DE)

( * ) Notice: Subject to any disclaimer, the term of this patent is extended or adjusted under 35 U.S.C. 154(b) by 672 days.

(21) Appl. No.: 11/592,375

(22) Filed: Nov. 3, 2006

(65) Prior Publication Data

US 2007/0123404 A1 May 31, 2007

(30) Foreign Application Priority Data

Nov. 4, 2005 (DE) ..... 10 2005 052 661

(51) Int. Cl.
*B31F 1/00* (2006.01)

(52) U.S. Cl. ..... 493/432; 493/360; 493/424; 493/434; 493/442

(58) Field of Classification Search ..... 493/432, 493/360, 424, 434, 442, 454
See application file for complete search history.

(56) References Cited

U.S. PATENT DOCUMENTS 1,310,667 A 7/1919 McCollum
2,093,235 A * 9/1937 Dean ..... 493/30
5,924,970 A * 7/1999 Wingate ..... 493/424
6,550,385 B1 * 4/2003 Colin et al. ..... 101/228
6,740,024 B2 * 5/2004 Kitai et al. ..... 493/428
7,416,522 B2 * 8/2008 Schmieder ..... 493/425

FOREIGN PATENT DOCUMENTS

| | | |
|---|---|---|
| DE | 103 14 945 A1 | 10/2004 |
| EP | 0 870 714 A1 | 10/1998 |
| GB | 14340 | 3/1911 |
| GB | 127520 | 6/1919 |
| GB | 1 310 667 | 3/1973 |
| JP | 10-330035 A | 12/1998 |

* cited by examiner

*Primary Examiner*—Hemant M Desai
(74) *Attorney, Agent, or Firm*—Crowell & Moring LLP

(57) ABSTRACT

A folding drum and method of operation is disclosed. The folding drum is used for folding material, in particular for a printing press. The folding drum is mounted rotatably on its longitudinal axle. The folding drum has a folding-blade spindle, the longitudinal axle of which is coupled to the longitudinal axle of the folding drum and is spaced apart from the longitudinal axle of the folding drum. Furthermore, the folding drum comprises a force generation means for generating a relief force which is opposed to a centrifugal force which is generated in the case of a rotating folding drum by the co-rotating folding-blade spindle. Thus, the disadvantageous influence of the centrifugal force can be reduced. As a result, in particular, a mounting of the folding-blade spindle can be relieved. The wear of the mounting can be reduced and its service life can be increased.

20 Claims, 2 Drawing Sheets

FOLDING DRUM AND METHOD OF OPERATION

This application claims the priority of German Patent Document No. 10 2005 052 661.6, filed Nov. 4, 2005, the disclosure of which is expressly incorporated by reference herein.

BACKGROUND AND SUMMARY OF THE INVENTION

The present invention relates to a folding drum for folding material, in particular for a printing press. The folding drum is mounted rotatably on its longitudinal axle and has a folding-blade spindle.

It is known for a printing press to comprise a folder, with which folds can be formed on printed material, in particular paper. A folder of this type comprises a folding drum, with which, in particular, longitudinal folds can be made in materials which have already been cut and prefolded. For this purpose, the folding drum has a folding-blade spindle, to which a folding blade is attached. The folding drum is mounted rotatably on its longitudinal axle and the folding-blade spindle is coupled to the longitudinal axle of the folding drum, with the result that the rotational movement of the folding drum is transmitted to the folding-blade spindle. As the longitudinal axle of the folding-blade spindle extends parallel to the longitudinal axle of the folding drum, the mass of the folding-blade spindle generates a radially outwardly acting centrifugal force during rotation of the folding drum. This centrifugal force represents a loading for the folding-blade spindle, in particular for its bearing, which loading can lead to disadvantages, in particular to high wear.

The invention is therefore based on the object of specifying a folding drum, in which these disadvantages are at least reduced.

The folding drum according to the invention serves to fold material, in particular in a printing press, and is mounted rotatably on its longitudinal axle. It has a folding-blade spindle, the longitudinal axle of which is coupled to the longitudinal axle of the folding drum and is spaced apart from the longitudinal axle of the folding drum. Furthermore, the folding drum comprises a force generation means for generating a relief force. The relief force is opposed to a centrifugal force which occurs in a rotating folding drum as a result of the co-rotating folding-blade spindle. The influence of the centrifugal force on the folding-blade spindle, and, in particular, on a bearing of the folding-blade spindle, is reduced by the generation of the relief force. As a result of the reduction in the radially outwardly directed loading of the folding-blade spindle, the service life of its bearing can be increased advantageously. It is also possible to increase the rotational speed of the folding drum, and therefore the processing speed, if required, without obtaining a disadvantageous loading of the folding-blade spindle as a result. On account of the configuration according to the invention of the folding drum, further supporting bearings for supporting the folding-blade spindle can advantageously be omitted. This is true, in particular, in the case of the use of groove ball bearings for mounting the folding-blade spindle.

The force generation means is advantageously coupled to the longitudinal axle of the folding drum. This ensures that the force generation means can rotate together with the folding drum, and likewise together with the folding-blade spindle. Here, the force generation means can be configured in such a way that it adapts the relief force to the rotational speed, and therefore to the centrifugal force which acts on the folding-blade spindle.

In one particularly advantageous refinement of the invention, the force generation means is guided by means of a guide which is configured in such a way that it permits the movement of the force generation means in the direction of the relief force and largely prevents a movement in at least one other direction. The guide therefore ensures that the relief force which can be generated by the force generation means can act completely counter to the centrifugal force which is generated by the folding-blade spindle.

There are particularly advantageous journals which are arranged on the outside on the opposite folding-drum sides for the rotatable mounting of the folding drum in a holding device. Moreover, the folding drum can have at least one extension of the journals into the interior of the folding drum. The guide is realized as a passage in this at least one extension. The guide can be realized in a particularly simple and reliable manner by way of this arrangement. Furthermore, both the rotation of the force generation means together with the rotation of the folding drum and the guidance of the force generation means can take place for the sake of simplicity via the at least one journal extension. As a result of this refinement of the at least one journal extension, the latter can therefore advantageously assume two functions at the same time.

In one advantageous development of the invention, the guide is provided with lubricating varnish and/or with a coating. The lubricating varnish makes largely frictionless sliding possible of the guided force generation means in the guide. The coating is advantageously selected in such a way that it prevents corrosion of the guide and/or of the force generation means.

In a further particularly advantageous refinement of the invention, the folding-blade spindle is divided into at least two part folding-blade spindles which are arranged next to one another. Here, the force generation means is configured in such a way that it acts between the part folding-blade spindles. In this way, the loading of the folding-blade spindle, in particular with respect to its bearing, and the effect of the centrifugal force which is generated by it during rotation can be reduced further.

The force generation means advantageously has at least one spring. A relief force which is independent of the rotational speed of the folding drum can be generated with at least one spring of this type. The at least one spring can be realized inexpensively and has a low weight. In addition or as an alternative, the force generation means can have at least one compensating mass. As a result, the generation of the relief force can be realized in a particularly simple and effective manner. The relief force which counteracts the centrifugal force can be set with the compensating mass as a function of the rotational speed of the folding drum. As the rotational speed increases, the level of the relief force is adapted automatically to the increasing level of the centrifugal force.

Further advantageous refinements and developments of the invention can be gathered from the description, with reference to the drawings.

BRIEF DESCRIPTION OF THE DRAWINGS

In the following text, the invention and its advantages will be explained in greater detail using the exemplary embodiments which are specified in the drawing figures, in which.

Identical or functionally identical elements are provided with the same reference numerals in the figures, unless otherwise specified.

DETAILED DESCRIPTION OF THE DRAWINGS

Figure 1:
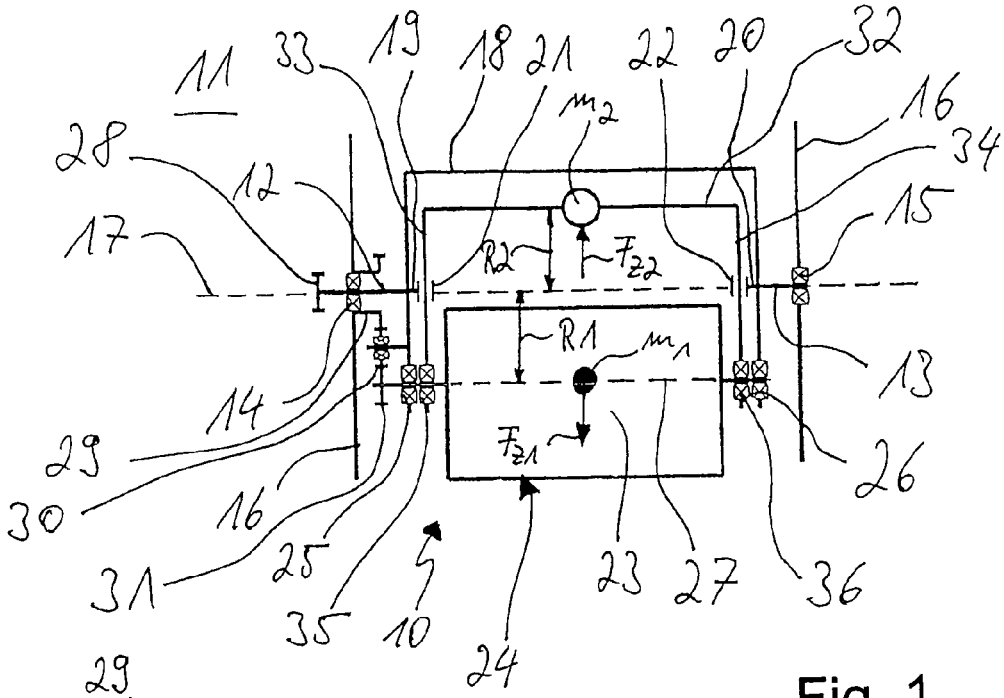
FIG. 1 shows a diagrammatic alternative illustration of a first exemplary embodiment of a folding drum according to the invention having a compensating mass as a force generation means.

FIG. 1 shows a diagrammatic alternative illustration of a first exemplary embodiment of a folding drum 10 according to the invention of a folder 11 of a printing press. Here, the printing press is a web-fed rotary printing press for printing and for processing web-shaped material. The material is paper. The folding drum 10 serves to make what are known as second longitudinal folds in the material which has already been cut and is provided both with first longitudinal folds and also with crossfolds. The folding drum 10 has two folding-drum sides which lie opposite one another and on which journals 12 and 13 are arranged on the outside. The journals 12, 13 serve to mount the folding drum 10 rotatably in a holding device which is a framework 16 here by means of two bearings 14 and 15. The folding drum 10 is therefore mounted in the framework 16 such that it can rotate about a longitudinal axle 17 which is defined by the journals 12, 13 and the positions of the two bearings 14, 15 and is not of continuous configuration. A folding-drum axle which is actually present, extends in a partially U-shaped manner and is formed substantially by the folding-drum sides and the folding-drum circumferential surface is provided with the reference symbol 18 in FIG. 1. The journals 13, 14 are extended into the interior of the folding drum by means of two extensions 19 and 20. The extensions 19 and 20 can be fastened, in particular welded, to the journals 13 and 14, respectively. However, it is also possible for the journals 13 and 14 and the associated extensions 19 and 20, respectively, to be configured in one piece. Guides 21 and 22 are formed on the ends of the extensions 19 and 20, respectively.

A folding-blade spindle 23, to which a folding blade 24 is fastened, is situated between the folding-drum sides of the folding drum 10. The folding-blade spindle 23 is mounted rotatably on the folding-drum sides by means of two bearings 25 and 26 which are, in particular, groove ball bearings. As a result, a longitudinal axle 27 of the folding-blade spindle 23 is fixed, about which longitudinal axle 27 the folding-blade spindle 23 is rotatable. The longitudinal axle 27 is spaced apart from the longitudinal axle 17 and extends parallel to the latter. On account of the mounting of the folding-blade spindle 23 in the folding-drum sides which are in turn connected to the journals 12, 13, the longitudinal axle 27 is coupled to the longitudinal axle 17. As a result, the rotation of the folding drum 10 can be transmitted to the folding-blade spindle 23.

The folder 11 has a drive 28 which serves to rotate the folding drum 10 and is, for example, a motor. The drive 28 acts on the journal 12 of the folding drum 10. The drive 28 comprises a gear mechanism which has a central internal gear 29 which is fastened to the framework 16. The rotational movement of the rotating folding-drum axle 18 is transmitted, via a likewise rotating intermediate gear 30 which is supported on the stationary internal gear 29 and is in engagement with a drive gear 31 on the folding-blade spindle 23, to precisely this folding-blade spindle 23. As a result, the rotatably mounted folding-blade spindle 23 can be rotated about its longitudinal axle 27 by the same drive 28, but at a different rotational speed to the folding drum 10. The two rotations about the longitudinal axle 17 of the folding drum 10 and the longitudinal axle 27 of the folding-blade spindle 23 can be adapted to one another via the suitable configuration of the gear mechanism.

During rotation of the folding drum 10, the rotation is transmitted to the folding-blade spindle 23 including the folding-blade 24. As a result, a centrifugal force is generated which acts on the folding-blade spindle 23 and has to be absorbed by the bearings 25 and 26. Absorbing the centrifugal force represents a great loading for the bearings 25, 26. They therefore have to be configured and dimensioned in a suitable manner. High rotational speeds of the folding drum cause a great centrifugal force, which can limit the service life of the bearings 25, 26 dramatically. The centrifugal force which is to be absorbed during rotation of the folding drum 10 by the two bearings 25 and 26 is determined roughly according to the formula $F_{Z1}=m_1 \cdot R_1 \cdot (2\pi \cdot n_T)^2$, $m_1$ corresponding to the mass of the folding-blade spindle 23, the folding blade 24 and the gearwheel mass, in particular the mass of the drive gear 31, $R_1$ corresponding to the spacing of the mass $m_1$ from the rotational axle, that is to say from the longitudinal axle 17 here, and $n_T$ corresponding to the rotational speed of the folding drum 10. It is assumed here that the mass $m_1$ is considered to be arranged as an alternative at the centroid of the folding-blade spindle 23. Furthermore, it is assumed that there is a symmetrical load distribution on the two bearings 25, 26, with the result that each bearing 25, 26 has to absorb the force of $F_{Z1}/2$. The mass $m_1$ which is arranged as an alternative in the centroid of the folding-blade spindle 23, the spacing $R_1$ and the centrifugal force $F_{Z1}$ are depicted in FIG. 1.

In order to reduce the effects of the centrifugal force $F_{Z1}$ on the bearings 25, 26, the folding drum 10 according to the invention comprises a compensating mass $m_2$ which can be configured as a cylindrical weight. In FIG. 1, the compensating mass $m_2$ is shown as an alternative as a mass which is present at the centroid of the compensating mass $m_2$. The longitudinal axle 32 of the compensating mass $m_2$ is spaced apart from the longitudinal axle 17 and extends parallel to the latter. The spacing is denoted by $R_2$. Here, the longitudinal axles 17, 27 and 32 are advantageously arranged in a common plane. As a result, the influence of the centrifugal force $F_{Z1}$ can be limited in a particularly satisfactory manner. The cylindrical compensating mass $m_2$ is connected to tie rods 33 and 34 at its ends. The tie rods 33 and 34 are connecting elements, with which the compensating mass $m_2$ is coupled to the longitudinal axle 27 of the folding-blade spindle 23. This coupling takes place by means of two bearings 35 and 36 which are arranged on both sides of the folding-blade spindle 23 on its longitudinal axle 27. The folding-blade spindle 23 can rotate in the bearings 35 and 36. The tie rods 33 and 34 are guided in the guides 21 and 22, respectively, and are connected to the bearings 35 and 36, respectively. The guides 21, 22 are configured in such a way that they permit only a movement of the tie rods 33 and 34 in a direction which is opposed to the direction of the centrifugal force $F_{Z1}$. The compensating mass $m_2$ is coupled to the longitudinal axle 17 of the folding drum 10 in such a way that the rotation of the folding drum 10 is transmitted to the compensating mass $m_2$. Here, this coupling of the compensating mass $m_2$ to the longitudinal axle 17 of the folding drum 10 is implemented by means of the extensions 19, 20 for the sake of simplicity. The guides 21, 22 are realized in the extensions 19, 20 as slot-shaped passages. The tie rods 33, 34 are led through these passages. The guides 21, 22 are advantageously provided with lubricating varnish and a coating. As a result, largely frictionless sliding of the tie rods 33, 34 in the guides 21, 22 can be ensured, and corrosion of the guides 21, 22 can be prevented.

The compensating mass $m_2$ serves as force generation means for generating a relief force which is oriented counter to the centrifugal force $F_{Z1}$ which is generated by the co-rotating folding-blade spindle 23 when the folding drum 10 rotates. As the rotation of the folding drum 10 is also transmitted to the compensating mass $m_2$, the latter generates a centrifugal force $F_{Z2}$ which represents the relief force. The centrifugal force $F_{Z2}$ acts radially outward and is transmitted to the tie rods 33, 34. As the latter are connected to the two bearings 35, 36, the centrifugal force $F_{Z2}$ is absorbed by the two bearings 35, 36 as a tensile force. As the bearings 25 and 35 on one side and the bearings 26 and 36 on the other side are placed directly next to one another on the longitudinal axle of the folding-blade spindle 23, the two centrifugal forces $F_{Z1}$, $F_{Z2}$ act in an opposed manner on directly adjacent points of the longitudinal axle 27. This is advantageous in the case of certain masses and rotational speeds. As the two centrifugal forces $F_{Z1}$, $F_{Z2}$ are directed counter to one another, the centrifugal force $F_{Z2}$ can reduce the influence of the centrifugal force $F_{Z1}$ on the bearings 25, 26 and the folding-blade spindle 23 and its longitudinal axle 27.

The centrifugal force $F_{Z2}$ which occurs during rotation of the folding drum 10 is defined roughly according to the formula $F_{Z2}=m_2 \cdot R_2 \cdot (2\pi \cdot n_T)^2$, $m_2$ corresponding to the compensating mass $m_2$, $R_2$ corresponding to the spacing of the mass $m_2$ from the rotational axle, that is to say from the longitudinal axle 17, and $n_T$ corresponding to the rotational speed of the folding drum 10. It is assumed here that the mass of the compensating mass $m_2$ is considered as an alternative to be arranged at its centroid. Given a symmetrical load distribution on the two bearings 25, 26, each of the bearings 25, 26 therefore has to absorb the resultant force of $F_R=F_{Z1}/2-F_{Z2}/2=(2\pi \cdot n_T)^2/2 \cdot (m_1 \cdot R_1-m_2 \cdot R_2)$. The loading of the bearings 25, 26 is therefore advantageously reduced compared with an implementation without compensating mass $m_2$.

Figure 2:
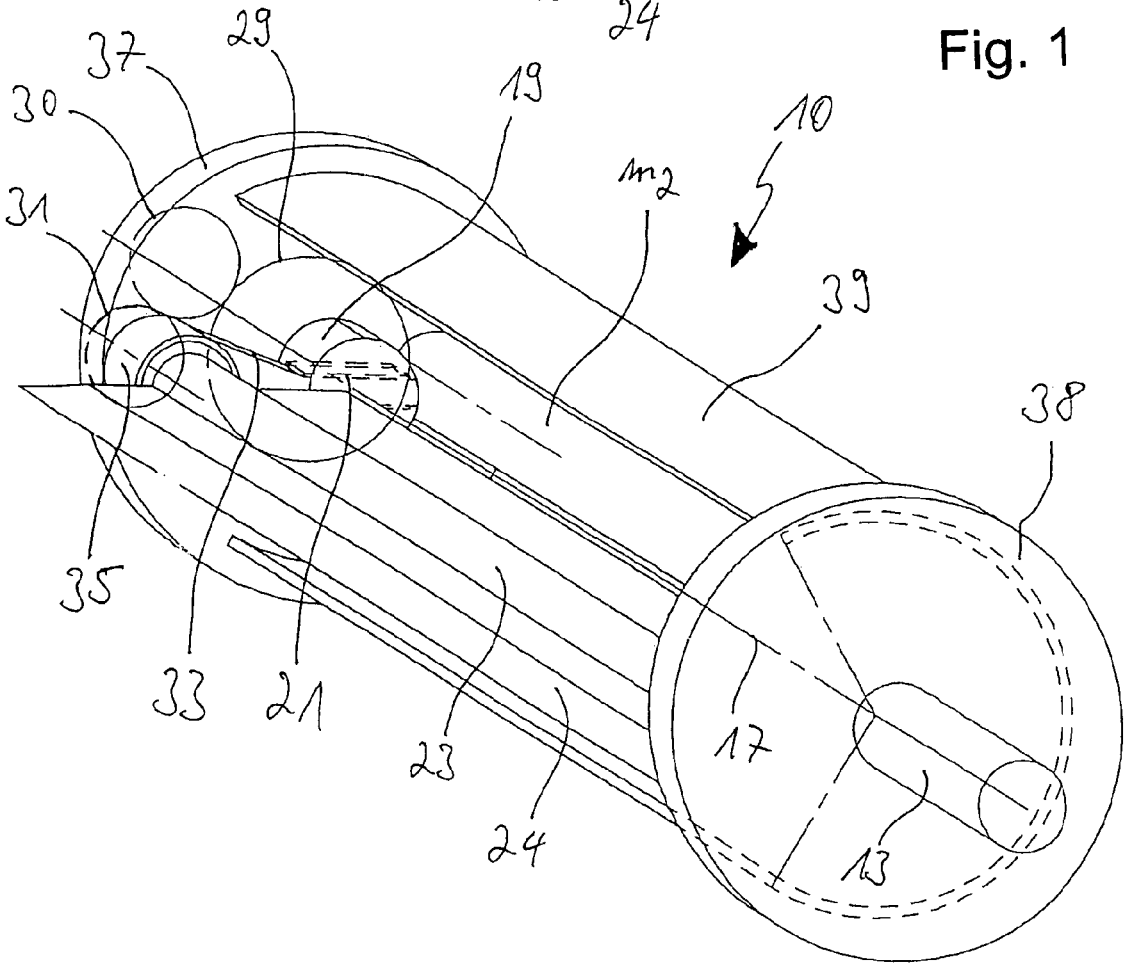
FIG. 2 shows a perspective, partially sectioned illustration of the folding drum in accordance with the first exemplary embodiment according to FIG. 1.

FIG. 2 shows a perspective, partially sectioned illustration of the folding drum 10 in accordance with the first exemplary embodiment according to FIG. 1. Folding-drum sides 37 and 38 are to be seen in this illustration, between which a folding-drum circumferential surface 39 is arranged. Furthermore, the folding blade 24 which is fastened to the folding-blade spindle 23 is shown clearly. The extension 19 of the journal 12, in which the guide 21 is configured as a slot-formed passage, is to be seen on the left-hand side of FIG. 2. The tie rod 33 which is fastened to the bearing 35 and the compensating mass $m_2$ is guided through the guide 21.

Figure 3:
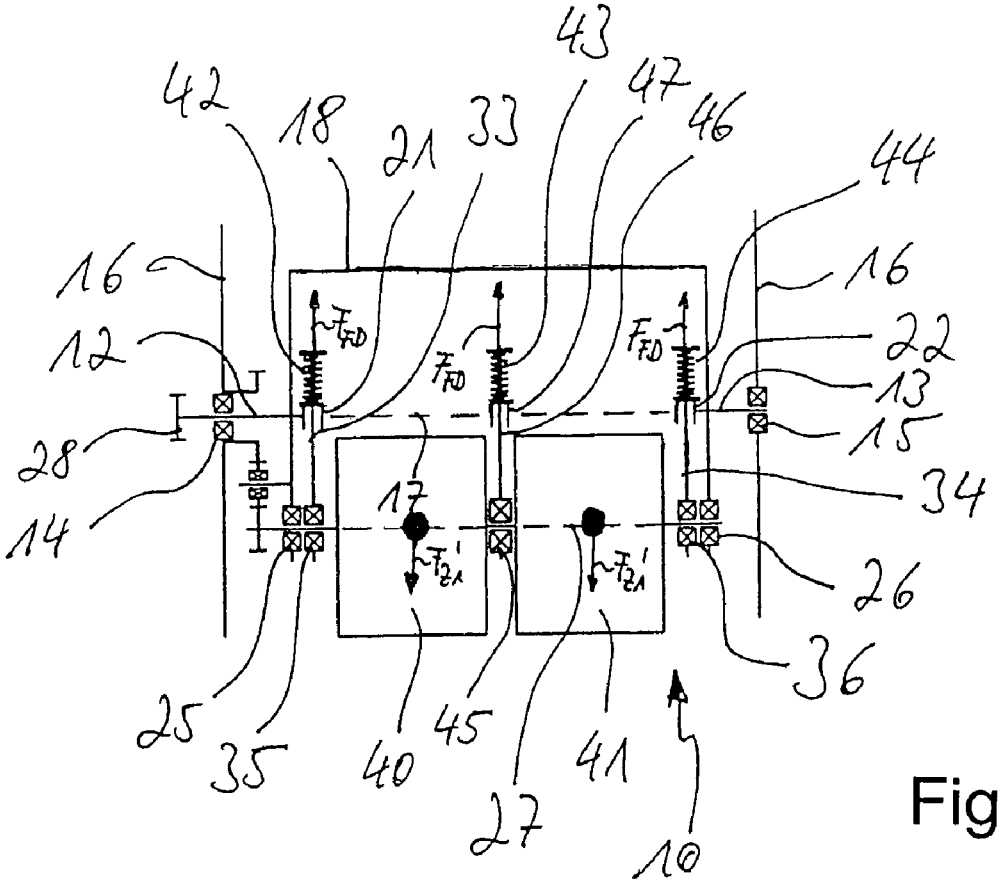
FIG. 3 shows a diagrammatic alternative illustration of a second exemplary embodiment of a folding drum according to the invention having three springs as a force generation means.

FIG. 3 shows a diagrammatic alternative illustration of the second exemplary embodiment of the folding drum 10 according to the invention. The folding drum 10 in accordance with the second exemplary embodiment comprises a folding-blade spindle which is divided into two part folding-blade spindles 40 and 41. In FIG. 2, three springs 42, 43 and 44 which are configured here as compression springs and serve as force generation means have taken the place of the compensating mass $m_2$ according to FIG. 1. A further bearing 45, in which the longitudinal axle 27 can rotate, is arranged between the two part folding-blade spindles 40, 41 on the longitudinal axle 27 of the folding-blade spindle. A further tie rod 46 which is guided through a further guide 47 is fastened to the bearing 45 on the outside. The bearing 45, the tie rod 46 and the guide 47 fulfill the same function as the bearings 35, 36, tie rods 33, 34 and guides 21, 22, which have already been described above, and are used in the second exemplary embodiment and are shown in FIG. 3. The springs 42, 43 and 44 are plugged onto the tie rods 33, 46 and 34, respectively, and are supported with, in each case, one of the ends on T-shaped regions at the ends of the tie rods 33, 34, 46. The springs 42, 43 and 44 are supported with the other ends on the guides 21, 47, and 22, respectively. As the springs 42, 43, 44 are configured here as compression springs, they exert compressive forces $F_{FD}$ on the T-shaped regions of the tie rods 33, 34, 46 which can move along the guides 21, 22, 47. These compressive forces $F_{FD}$ represent the tensile loading on the bearings 35, 36 and 45, the direction of which is oriented counter to the direction of the centrifugal forces $F_{Z1}$ which are generated during rotation of the folding drum 10 by the part folding-blade spindles 40, 41. The spring axes of the springs 42, 43 and 44 extend perpendicularly with respect to the longitudinal axle 27 of the part folding-blade spindles 40, 41. As a result, the bearings 25, 26 can be relieved particularly efficiently, as the compressive forces $F_{FD}$ can be used largely for relief. The compressive forces $F_{FD}$ are independent of the rotational speed of the folding drum 10. They can therefore be used to set the basic load which is independent of the rotational speed for relieving the bearings 25, 26 of the folding-blade spindle. The relief of the bearings 25, 26 can be improved still further by the division of the folding-blade spindle into the two part folding-blade spindles 40, 41 and the attachment of an additional third relief train, that is to say the arrangement of the bearing 45, the tie rod 46, the guide 47 and the spring 43.

Figure 4:
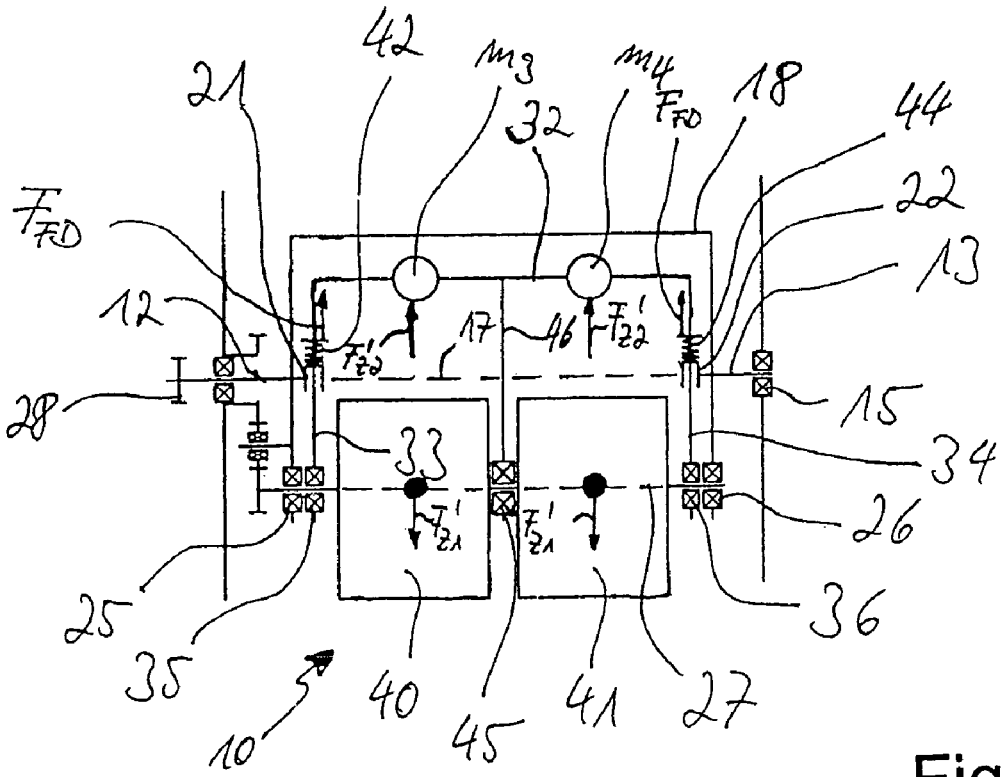
FIG. 4 shows a diagrammatic alternative illustration of a third exemplary embodiment of a folding drum according to the invention having a force generation means which is combined from two springs and two compensating masses.

FIG. 4 shows a diagrammatic alternative illustration of the third exemplary embodiment of the folding drum 10 according to the invention. The folding drum in accordance with the third exemplary embodiment has the two part folding-drum spindles 40, 41, like the folding drum 10 in accordance with the second exemplary embodiment. There is a combination of two springs 42 and 44 and two compensating masses $m_3$ and $m_4$ as force generation means. Compressive forces $F_{FD}$ are generated with the springs 42, 44 and centrifugal forces $F_{Z2'}$ which counteract the centrifugal forces $F_{Z1'}$ which are generated by the part folding-blade spindles 40, 41 are generated with the compensating masses $m_3$ and $m_4$. The tie rods 33 and 34 are configured here in such a way that they protrude beyond the T-shaped regions, in contrast to the second exemplary embodiment, and are connected to the compensating masses $m_3$ and $m_4$. The bearing 45 which is arranged between the two part folding-blade spindles 40, 41 is likewise connected to the two compensating masses $m_3$ and $m_4$ by means of the tie rod 46. No spring is attached to the tie rod 46. The principle of the method of operation of the relief of the bearings 25, 26 by means of springs and compensating masses has already been described in the above text. This principle can be transferred to the folding drum 10 in accordance with the third exemplary embodiment. It is therefore not repeated at this point.

LIST OF REFERENCE NUMERALS

10 Folding drum
11 Folder
12 Journal

13 Journal
14 Bearing
15 Bearing
16 Framework
17 Longitudinal axle of the folding drum
18 Folding-drum axle
19 Extension
20 Extension
21 Guide
22 Guide
23 Folding-blade spindle
24 Folding blade
25 Bearing
26 Bearing
27 Longitudinal axle of the folding-blade spindle
28 Drive
29 Internal gear
30 Intermediate gear
31 Drive gear
32 Longitudinal axle of the compensating mass
33 Tie rod
34 Tie rod
35 Bearing
36 Bearing
37 Folding-drum side
38 Folding-drum side
39 Folding-drum circumferential surface
40 Part folding-blade spindle
41 Part folding-blade spindle
42 Spring
43 Spring
44 Spring
45 Bearing
46 Tie rod
47 Guide
$m_1$ Mass of folding-blade spindle, folding blade, drive gear
$R_1$ Spacing of longitudinal axle—mass $m_1$
$F_{Z1}$ Centrifugal force
$m_2$ Compensating mass
$R_2$ Spacing of longitudinal axle—mass $m_2$
$F_{Z2}$ Centrifugal force
$F_{FD}$ Compressive forces of the springs
$m_3$ Compensating mass
$m_4$ Compensating mass
$F_{Z1'}$ Centrifugal force
$F_{Z2'}$ Centrifugal force The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A folding drum for folding material, in particular for a printing press, the folding drum rotatably mounted on a longitudinal axle and having a folding-blade spindle, a longitudinal axle of which is coupled to the longitudinal axle of the folding drum and is spaced apart from the longitudinal axle of the folding drum, and a force generation means for generating a relief force, wherein the relief force is opposed to a centrifugal force which is generated by the folding-blade spindle when co-rotating with the folding drum.

2. The folding drum according to claim 1, wherein the force generation means is coupled to the longitudinal axle of the folding drum.

3. The folding drum according to claim 1, wherein the force generation means is connected to the longitudinal axle of the folding-blade spindle.

4. The folding drum according to claim 3, wherein the folding-blade spindle is mounted rotatably on its longitudinal axle, and a first bearing which is connected to the force generation means is arranged on the longitudinal axle.

5. The folding drum according to claim 4, wherein the folding-blade spindle is mounted rotatably by means of a second bearing, and the first bearing is arranged adjacently with respect to the second bearing.

6. The folding drum according to claim 1, wherein journals are arranged on an outside on opposite folding-drum sides for rotatable mounting of the folding drum in a holding device.

7. The folding drum according to claim 6, wherein the folding drum has at least one extension of the journals into an interior of the folding drum and wherein a guide is provided in the at least one extension, and further wherein the force generation means is guided by the guide which is configured such that it permits a movement of the force generation means in a direction of the relief force and prevents a movement of the force generation means in at least one other direction.

8. The folding drum according to claim 1, wherein the force generation means is guided by means of a guide which is configured such that it permits a movement of the force generation means in a direction of the relief force and prevents a movement of the force generation means in at least one other direction.

9. The folding drum according to claim 8, wherein the guide is provided with lubricating varnish and/or with a coating.

10. The folding drum according to claim 1, wherein the folding-blade spindle is divided into at least two part folding-blade spindles which are arranged next to one another, and wherein the force generation means acts between the part folding-blade spindles.

11. The folding drum according to claim 1, wherein the force generation means has a plurality of part force generation means.

12. The folding drum according to claim 1, wherein the force generation means includes at least one spring.

13. The folding drum according to claim 12, wherein a spring axis of the least one spring runs perpendicularly with respect to the longitudinal axle of the folding-blade spindle.

14. The folding drum according to claim 1, wherein the force generation means includes at least one compensating mass.

15. The folding drum according to claim 14, wherein the at least one compensating mass is of cylindrical configuration.

16. The folding drum according to claim 15, wherein a longitudinal axle of the at least one compensating mass lies in one plane with the longitudinal axle of the folding-blade spindle and the longitudinal axle of the folding drum.

17. An apparatus for folding material, comprising:

a folding drum rotatably mounted on a longitudinal axle;

a folding-blade spindle coupled to the folding drum and co-rotational with the folding drum; and a counter-force mechanism coupled to the folding drum and co-rotational with the folding drum, wherein the counter-force mechanism generates a force when rotating which is opposed to a centrifugal force generated by the folding-blade spindle when rotating.

18. The apparatus according to claim 17, wherein the counter-force mechanism includes a spring.

19. A method of operating a folding drum, comprising the steps of:

rotating the folding drum;

rotating a folding-blade spindle coupled to the folding drum;

generating a centrifugal force by the rotating folding-blade spindle;

rotating a counter-force mechanism coupled to the folding drum; and generating a force by the rotating counter-force mechanism which is opposed to the centrifugal force generated by the folding-blade spindle.

20. The method according to claim 19, wherein the step of generating the force by the rotating counter-force mechanism includes the step of compressing a spring.

* * * * *